US006457419B1

(12) United States Patent
Lopez Gomez et al.

(10) Patent No.: US 6,457,419 B1
(45) Date of Patent: Oct. 1, 2002

(54) TRAIN AXLE SYSTEM WITH MOVABLE WHEELS

(75) Inventors: José Luis Lopez Gomez; Julio Frutos Aguado; José Borrajo Mora, all of Madrid (ES)

(73) Assignee: Patentes Talgo, S.A., Madrid (ES)

( * ) Notice: Subject to any disclaimer, the term of this patent is extended or adjusted under 35 U.S.C. 154(b) by 0 days.

(21) Appl. No.: 09/717,924

(22) Filed: Nov. 21, 2000

(30) Foreign Application Priority Data

Dec. 3, 1999 (ES) ..... P9902677

(51) Int. Cl.[7] ..... B41F 7/00

(52) U.S. Cl. ..... 105/178; 105/96; 105/218.1; 105/157.1; 104/33

(58) Field of Search ..... 105/178, 96, 96.1, 105/218.1, 157.1; 295/44, 10, 36.1; 104/33; 384/584, 551

(56) References Cited

FOREIGN PATENT DOCUMENTS

| | | | |
|---|---|---|---|
| EP | 0594040 A1 * | | 4/1994 |
| EP | 0594040 | | 4/1994 |
| EP | 0802101 | | 10/1997 |
| EP | 0873929 | | 10/1998 |
| EP | 0873929 A2 | * | 10/1998 |
| FR | 1443512 | * | 5/1966 |
| FR | 1443512 | | 9/1966 |
| FR | 1558329 A | * | 1/1969 |
| FR | 1558329 | | 2/1969 |

* cited by examiner

*Primary Examiner*—S. Joseph Morano
*Assistant Examiner*—Frantz F. Jules
(74) *Attorney, Agent, or Firm*—Ladas & Parry

(57) ABSTRACT

A train axle system with movable wheels, comprising an axle whose necks, where the wheels are positioned, are provided with a toothing formed with straight teeth having axial generators, the inner part of the wheel hubs having a similar toothing so that the rotating wheel is joined to the axle when it occupies positions corresponding to two track gauges, the axial blocking of the wheel being carried out by means of an outer locking bolt, there being attached to the end of the axle an external bearing (1) which supports the vertical load through a supporting part, the hub of the wheel (R) having a tubular extension with a central roller bearing (3) and two axial bearings (4), there being attached on the central bearing (3) a part (5) with protuberances (6) which assist in immobilising the wheel in each track gauge.

6 Claims, 6 Drawing Sheets

TRAIN AXLE SYSTEM WITH MOVABLE WHEELS

FIELD OF THE INVENTION

The invention refers to a new train axle system with movable wheels which can be used in tracks of different gauges.

BACKGROUND OF THE INVENTION

The present system is an additional development of the work carried out by the applicant in the field of the construction of rail vehicles with wheels that are movable to adjust to different track gauges. Thus, patent FR-A-1 558 329 describes a single axle bogie with a variable separation between the wheels which allows a solution to the problem of a bogie being used to travel on two different track gauges, for example that normally used in Spain and that normally used in France and other European countries.

Moreover, in EP-A-0 802 101 a train axle assembly is described which is provided with an automatic change of track gauge and which can be adapted to conventional bogies with a fixed distance between their wheels, so that a conventional rail vehicle, suitable for travelling on a single track gauge becomes capable, after fitting the said train axle assembly, of travelling on a different track gauge, for example passing from the Spanish rail network to the French network, and vice versa.

SUMMARY OF THE INVENTION

The system of the present invention has three versions and is made up basically of an axle whose necks, where the wheels are positioned, are provided with a toothing formed with straight teeth and whose generatrices extend in the axial direction.

The inner part of the wheel hub also has a similar toothing which will allow the rotating wheel to be joined to the axle when it occupies the two positions corresponding to the track gauges.

Axial blockage of the wheel is carried out by means of one or two locking bolts in a similar way to that used in the TALGO® system of movable independent wheels.

BRIEF DESCRIPTION OF THE DRAWINGS

The invention is illustrated in the drawings in which.

DESCRIPTION OF THE INVENTION

There follows a description of each of the three versions of the invention with reference to the corresponding figures of drawings.

First Variant

Includes a locking bolt situated in an outer position.

Figure 1A:
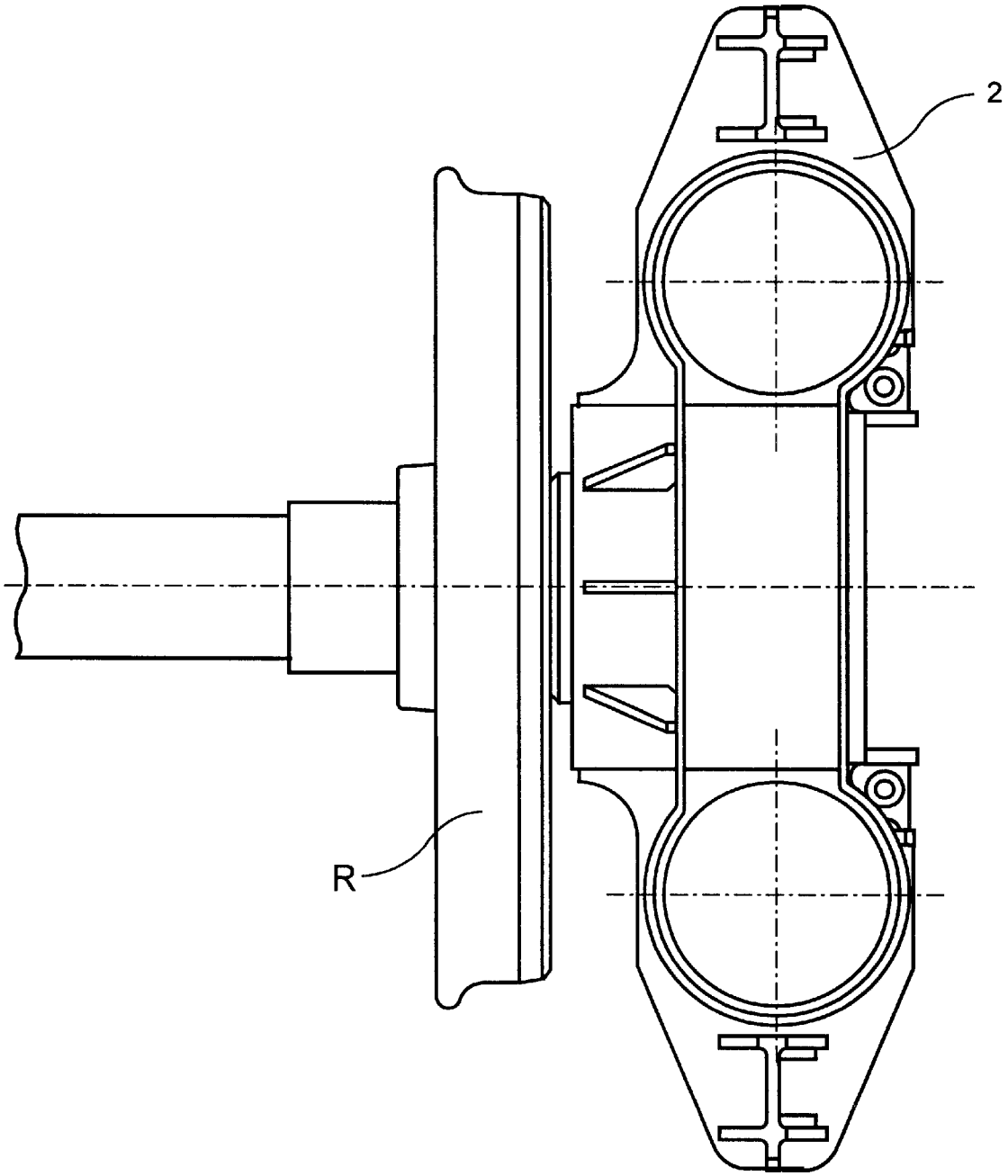
FIGS. 1A–C show three views of a train axle system in accordance with a first variant of the invention.
Figure 1C:
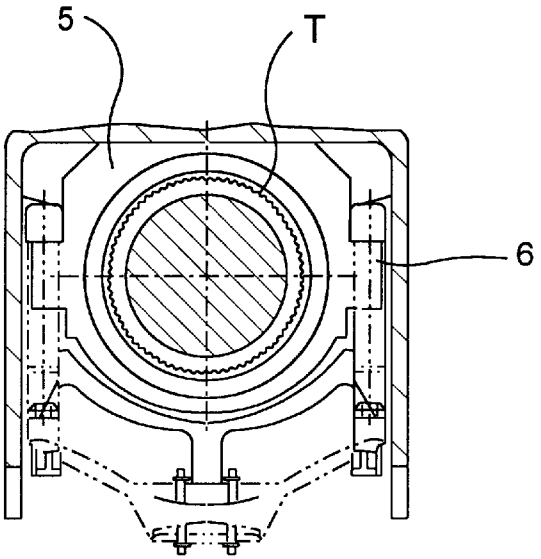
Figure 1B:
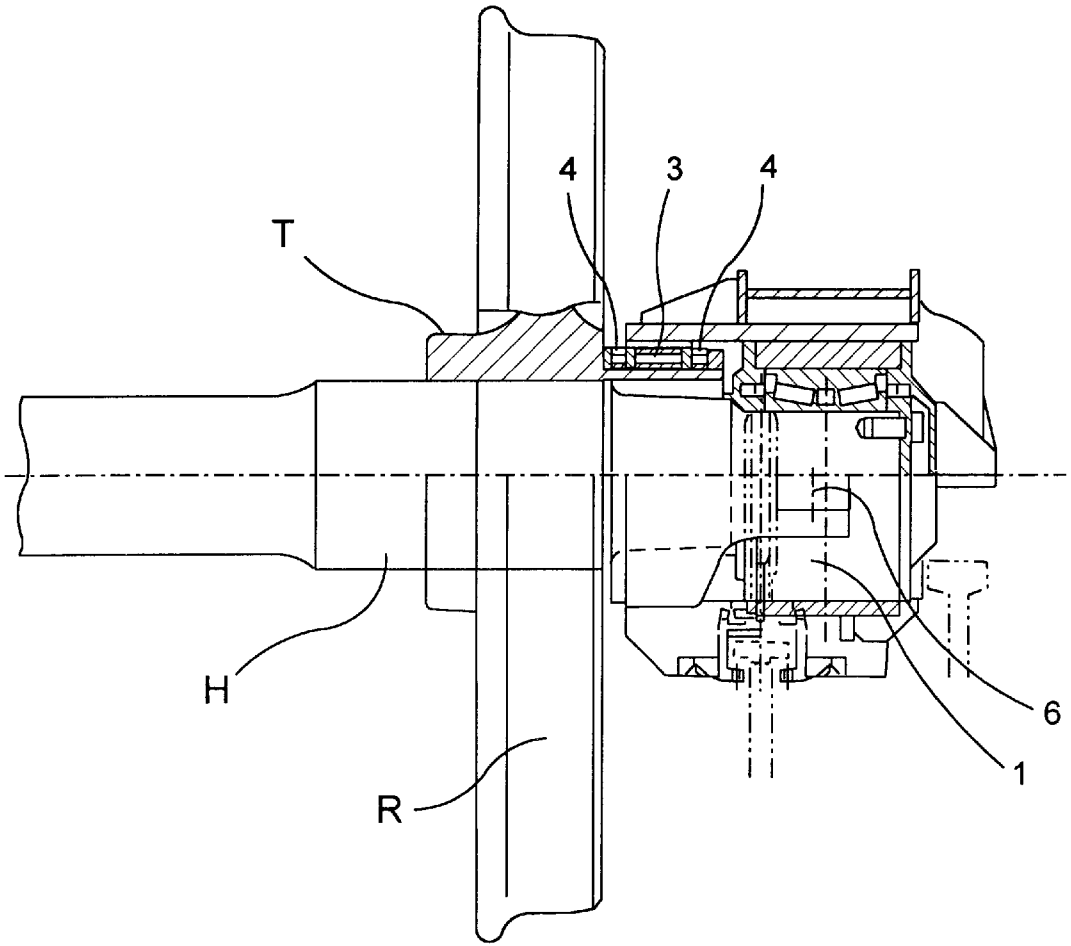

As may be observed in figures 1A–C, on the end of the axle an outer bearing (1) is attached, which supports the vertical load through a supporting part (2).

The hub of the wheel R has a tubular extension in its outer side, on which, externally, a central roller bearing (3) is incorporated and, on its sides, two axial bearings (4).

On the central bearing a part (5) is externally attached, which in its outer part has on each side protuberances (6) which, being in contact with the rods of the wheel locking bolts, immobilise the wheel in each track gauge.

The process whereby the wheel passes from one track gauge to another is to be carried out on an exchanger of the existing type and will consist of the following operations:

Unloading of the wheels, the axle being supported on skids.

Lowering of the bolts and axial unblocking of the wheels.

Moving of the wheels to the other gauge. The moving of the wheels is achieved by the provision of straight teeth T extending axially on the wheel hub which slidably engage corresponding straight teeth T on the neck of the axle.

Axial blockage of the wheels by means of raising the bolts.

Supporting of the wheels upon the rails of the track.

Second Variant

Figure 2A:
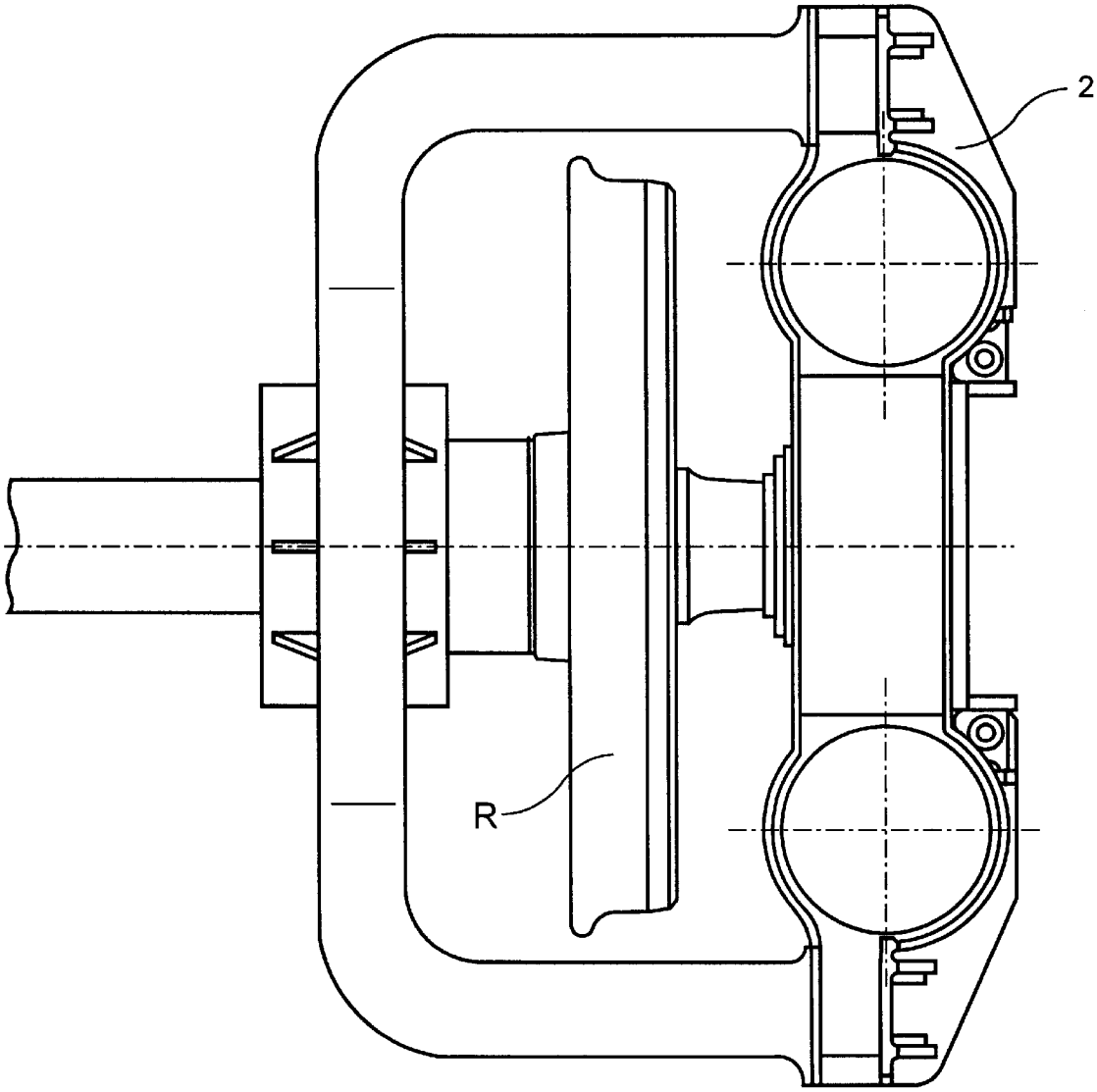
FIGS. 2A–C show three views of a train axle system in accordance with a second variant of the invention.
Figure 2C:
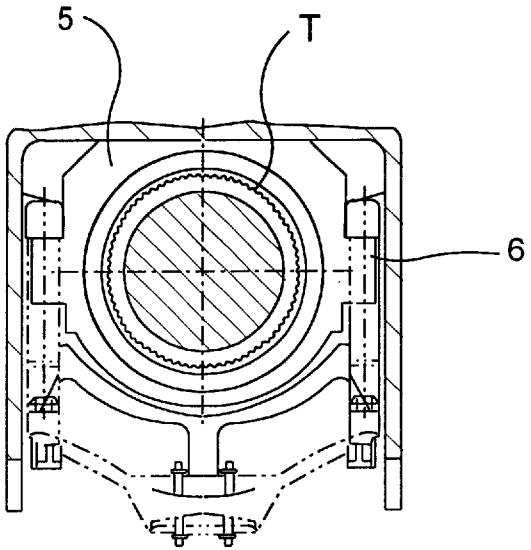
Figure 2B:
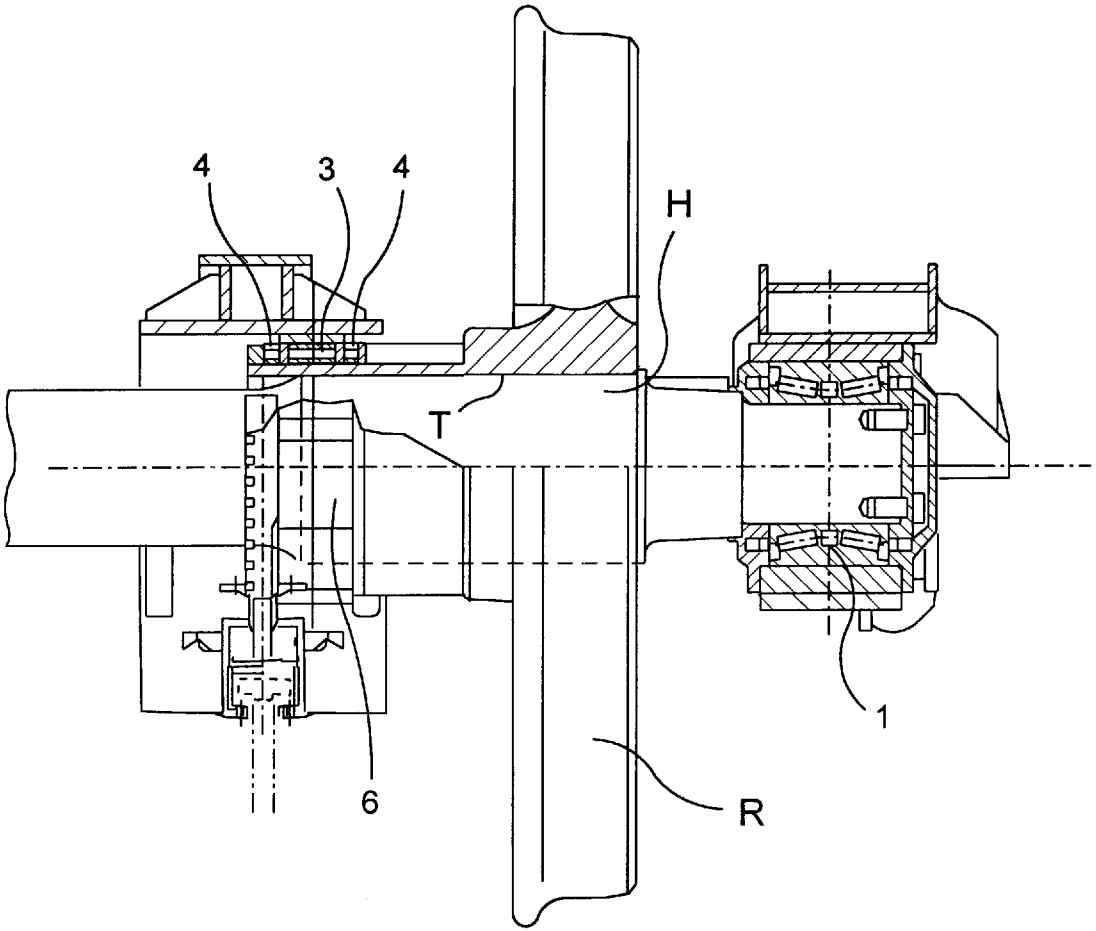

This variant, illustrated in FIGS. 2A–C, includes a locking bolt situated in an inner position.

In this case, the mounting of the outer bearing (1) on the end of the axle is similar to the foregoing version.

The hub H of the wheel R has a tubular extension in its outer side, on which, externally, a central roller bearing (3) is incorporated and, on its sides, two axial bearings (4).

The hub of the wheel extends inwards and on its outer part a central bearing (3) and two axial thrust lateral (4) are attached.

In a similar way to the first variant, there is a part (5) which is attached to the outer part of the central bearing and which, in both parts, has protuberances (6) which immobilise the wheel when in contact with the rods of the locking bolt.

In this case, the part (2) supporting the vertical load extends inwards, as in this part the locking bolt is now fitted.

The process whereby the wheel pass from one track gauge to another is to be carried out as in the first variant.

Third Variant

Figure 3A:
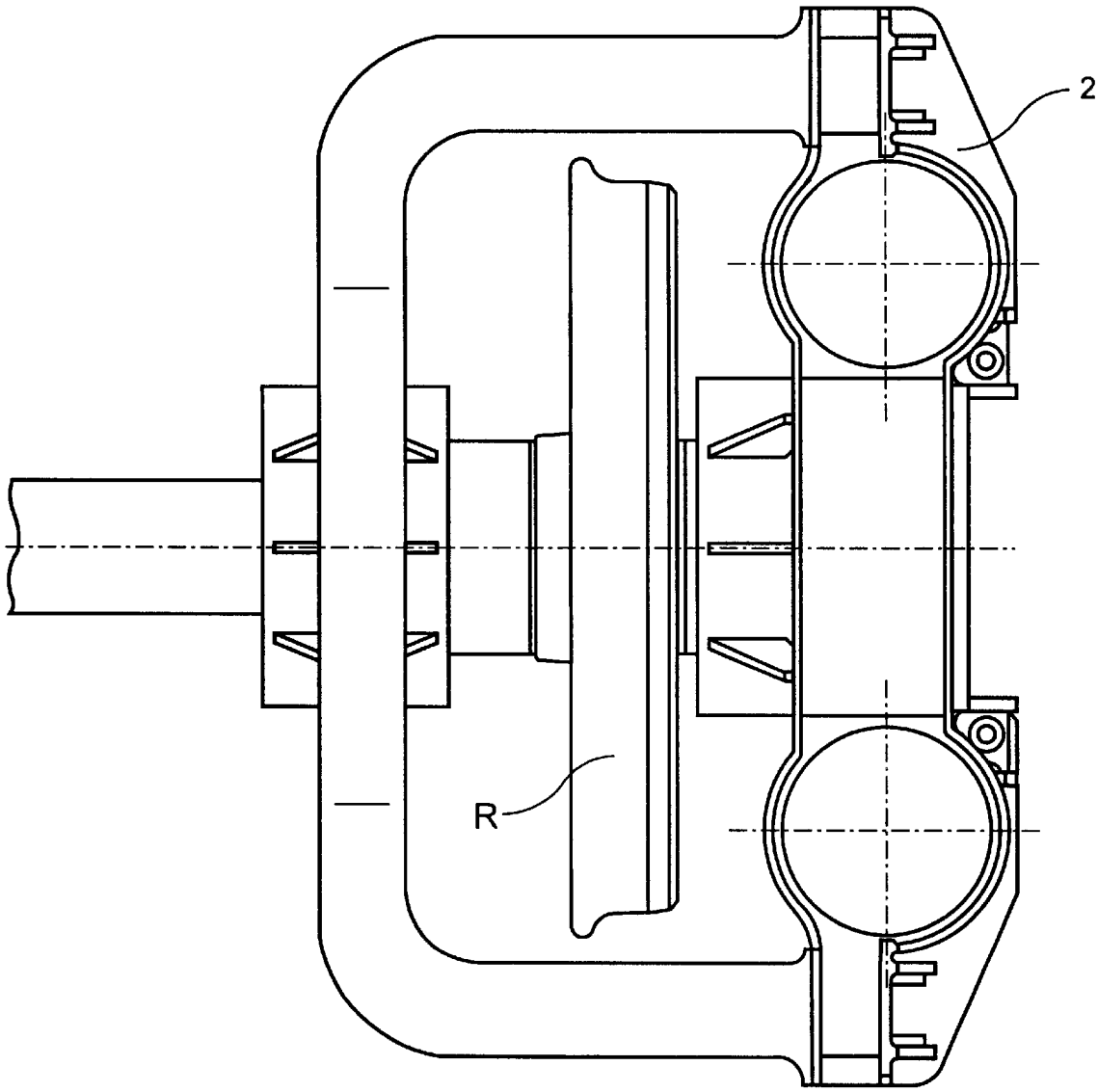
FIGS. 3A–C show three views of a train axle system in accordance with a third variation of the invention.
Figure 3C:
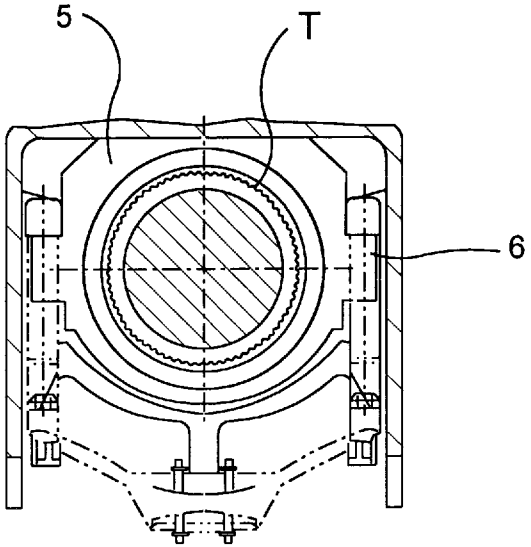
Figure 3B:
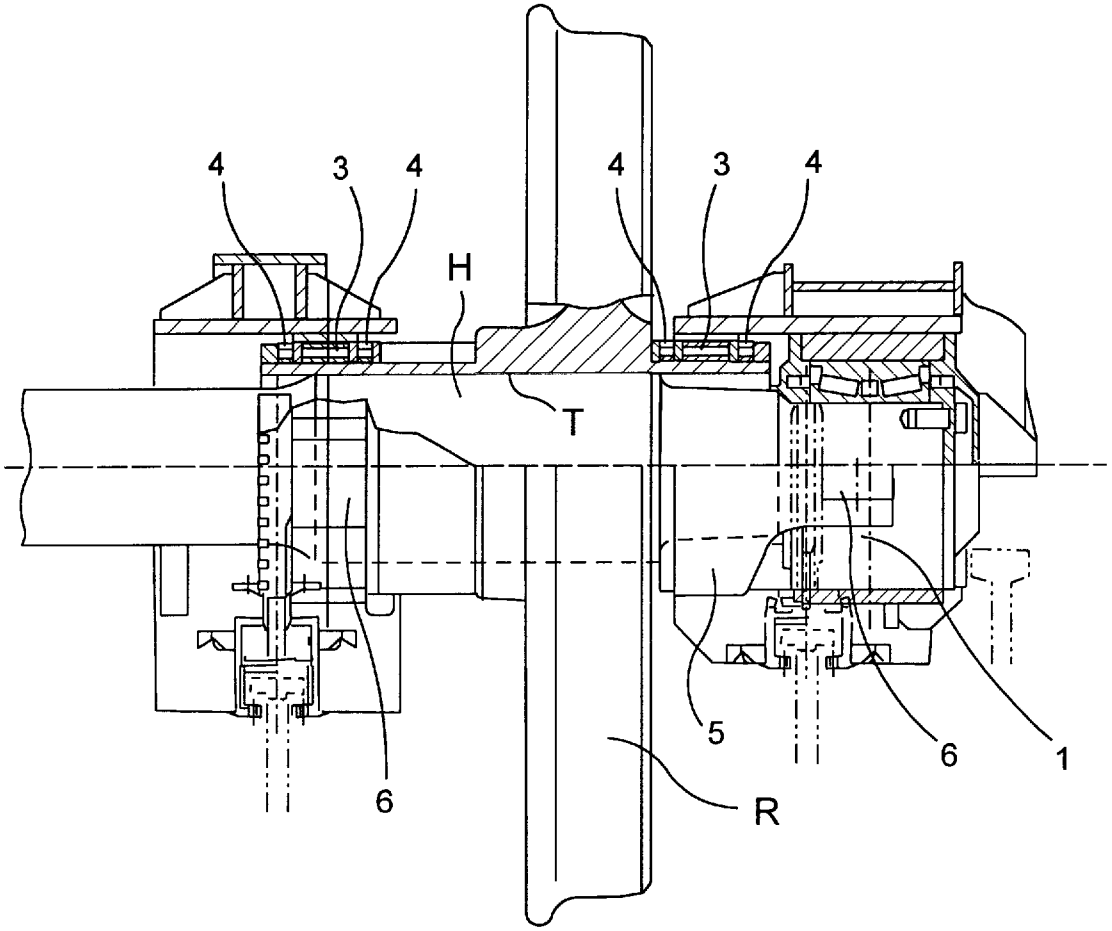

This variant, illustrated in FIGS. 3A–C, incorporates double bolting, that is, on both inner and outer parts. Therefore, it is a combination of the two foregoing variants in which the load support (2) is similar to the second variant, the hub of the wheel R extends inwards and outwards, and, in each of these extensions, central roller bearings (3) and two pairs of axial thrust bearings (4) are attached.

This variant has the advantage that bolting is duplicated.

The process whereby the wheel passes from one track gauge to another is to be carried out as in the foregoing versions.

The skilled persons will understand that in the foregoing description of the currently preferred embodiments of the invention, which are provided solely for illustrative purposes, modifications may be carried out which will remain within the scope of the present invention, as defined by the content of the attached claims.

What is claimed is:

1. A train axle system for supporting wheels in two axially spaced positions to adapt the wheels to two different gauge tracks, said axle system comprising an axle having necks on which the wheels are mounted, said necks having an external toothing with straight teeth extending in an axial direction, said wheels having hubs with inner teeth engaged with the teeth on the axle necks to rotationally connect the axle and the wheels and permit the wheels to be moved to said two axially spaced positions, means for axially locking the wheels in said two positions including two locking bolts, said locking bolts being disposed at an outer end of said axle, an external bearing mounted on said outer end of said axle for supporting vertical load, a tubular extension extending outwardly from said hub, a central roller bearing on said tubular extension and end axial bearings on opposite sides of said roller bearing, a part externally attached to said central roller bearing, said part having outer protuberances on opposite sides of the part, said locking bolts being removably engaged with said protuberances to secure the wheels in the two axially spaced positions of the wheels in correspondence with the two different track gauges.

2. The train axle system of claim 1, wherein said locking bolts and said protuberances are disposed outwardly of said wheels.

3. The train axle system of claim 2, wherein said part and said external bearing are connected together.

4. A train axle system for supporting wheels in two axially spaced positions to adapt the wheels to two different gauge tracks, said axle system comprising an axle having necks on which the wheels are mounted, said necks having a toothing with straight teeth extending in an axial direction, said wheels having hubs with inner teeth engaged with the teeth on the axle necks to rotationally connect the axle and the wheels and permit the wheels to be moved to said two axially spaced positions, means for axially locking the wheels in said two positions including two locking bolts, said locking bolts being disposed at an inner position of said axle, an external bearing mounted on said outer end of said axle for supporting vertical load, a tubular extension extending inwardly from said hub, a central roller bearing on said tubular extension and end axial bearings on opposite sides of said roller bearing, a part externally attached to said central roller bearing, said part having outer protuberances on opposite sides of the part said locking bolt being removably engaged with said protuberances to secure the wheels in the two axially spaced positions of the wheels in correspondence with the two different track gauges.

5. The train axle system of claim 4, wherein said locking bolts and said protuberances are disposed inwardly of said wheels.

6. A train axle system for supporting wheels in two axially spaced positions to adapt the wheels to two different gauge tracks, said axle system comprising an axle having necks on which the wheels are mounted, said necks having an external toothing with straight teeth extending in an axial direction, said wheels having hubs with inner teeth engaged with the teeth on the axle necks to rotationally connect the axle and the wheels and permit the wheels to be moved to said two axially spaced positions, means for axially locking the wheels in said two positions including two pairs of locking bolts one of said pairs of locking bolts being disposed at an outer position of said axle, and the other pair of locking bolts being disposed at an inner position of said axle an external bearing mounted on said outer end of said axle for supporting vertical load, a first tubular extension extending outwardly from said hub, a first central roller bearing on first tubular extension, first end axial bearings on opposite sides of said first roller bearing, a first part externally attached to said first central roller bearing, said first part having two outer protuberances on opposite sides of the first part, said one pair of locking bolts being removably engaged with said two protuberances to secure the wheels in the two axially spaced positions of the wheels in correspondence with the two different track gauges, a second tubular extension extending inwardly from said hub, a second central roller bearing on said second tubular extension, second end axial bearings on opposite sides of said second roller bearing, a second part externally attached to said second roller bearing, said second part having two outer protuberances on opposite sides of the second part, said other pair of locking bolts being removably engaged with said two protuberances on said second part to also secure the wheels in said two axially spaced positions.

* * * * *